US008533939B2

(12) United States Patent
Stull

(10) Patent No.: US 8,533,939 B2
(45) Date of Patent: Sep. 17, 2013

(54) COMPRESSION TOOL

(75) Inventor: David Michael Stull, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 27 days.

(21) Appl. No.: 13/027,922

(22) Filed: Feb. 15, 2011

(65) Prior Publication Data

US 2012/0204417 A1 Aug. 16, 2012

(51) Int. Cl.
*H01R 43/01* (2006.01)

(52) U.S. Cl.
USPC ..... 29/749; 29/751

(58) Field of Classification Search
CPC ..... H01R 43/015; H01R 43/0425
USPC ..... 29/751, 749, 750
See application file for complete search history.

(56) References Cited

U.S. PATENT DOCUMENTS 6,591,487 B2 * 7/2003 Chang ..... 29/751

FOREIGN PATENT DOCUMENTS

| | | | |
|---|---|---|---|
| EP | 0032616 | A1 | 7/1981 |
| EP | 0862250 | A1 | 9/1998 |
| EP | 1484824 | A2 | 12/2004 |
| EP | 2166625 | A2 | 3/2010 |
| EP | 2293395 | A1 | 3/2011 |

OTHER PUBLICATIONS

European Search Report, Mail Date Apr. 5, 2012, EP 12 15 5392, Application No. 12155392.9-1231.
Drawing No. 1725150, Rev. D, SL Series Jack Tool With Foil Cutter, Aug. 19, 2003, 1 pg, Tyco Electronics, Harrisburg, PA.
Instruction Sheet 408-8858, SL Jack Tool Kit 17251501-[], Apr. 16, 2010, Rev. K, 6 pgs, Tyco Electronics, Berwyn, PA.

* cited by examiner

*Primary Examiner* — Livius R Cazan

(57) ABSTRACT

A compression tool for terminating wires to a connector includes a frame that has a receiving space configured to receive the connector. A handle is rotatably coupled to the frame. A ram is held by the frame. The ram has an engagement end within the receiving space that is configured to engage the connector. The ram is movable between an initial position and a final position. A link is coupled between the ram and the handle. The link is variably positionable with respect to at least one of the handle or the ram to change the final position of the ram within the receiving space to control a shut height of the compression tool.

20 Claims, 3 Drawing Sheets

COMPRESSION TOOL

BACKGROUND OF THE INVENTION

The subject matter herein relates generally to compression tools for terminating wires to electrical connectors.

Compression tools are known for terminating wires to electrical connectors such as connectors. The connectors are loaded into the compression tool and a handle is squeezed to press the connector onto the wires to make electrical connection therebetween. For example, the connector may include insulation displacement contacts (IDCs) that are pressed onto the wires to make electrical connection therebetween. The compression tools typically include a ram connected to the handle that is actuated when the handle is squeezed. The ram engages the connector and presses the connector onto the wires.

Known compression tools are not without disadvantages. For instance, the compression tools have a fixed relationship between the ram and the handle such that the compression tools have a single shut height. In other words, the ram is pressed to the same final position every time the handle is squeezed to the closed position. However, typically different sized connectors are known and in use. In order for the tool to be used with different sized connectors, the connector includes a family of spacers that may be placed in the space between the ram and the connector to change the shut height of the compression tool. The spacers are separate components and may be easily lost, and increase the overall cost of the compression tool.

In some situations, when long connectors are being terminated, the operator uses the tool by only partially closing the handle to an intermediate, rather than fully closed, position to reduce the shut height of the compression tool to accommodate the longer connector. However, such use of the compression tool requires a skillful operator and extra time as the operator must estimate the amount of closing needed to fully terminate the connector to the wires. Partial termination may occur, leading to a defective connector. Additionally, overclosing may lead to damage to the connector.

A need remains for a compression tool that can terminate different sized electrical connectors. A need remains for a compression tool that allows the ram to be variably positionable with respect to the handle to define different shut heights for the compression tool.

BRIEF DESCRIPTION OF THE INVENTION

In one embodiment, a compression tool is provided for terminating wires to a connector. The compression tool includes a frame that has a receiving space configured to receive the connector. A handle is rotatably coupled to the frame. A ram is held by the frame. The ram has an engagement end within the receiving space that is configured to engage the connector. The ram is movable between an initial position and a final position. A link is coupled between the ram and the handle. The link is variably positionable with respect to at least one of the handle or the ram to change the final position of the ram within the receiving space to control a shut height of the compression tool.

In another embodiment, a compression tool is provided for terminating wires to a connector that includes a frame that has a receiving space configured to receive the connector. A handle is rotatably coupled to the frame. A ram is held by the frame. The ram has an engagement end within the receiving space that is configured to engage the connector. The ram has an actuation end opposite the engagement end. The ram has at least two ram cradles in the actuation end. The ram is movable between an initial position and a final position. A link is coupled to the handle. The link has a ram end configured to be selectively received in the ram cradles. The final position of the ram within the receiving space is controlled based on the ram cradle in which the ram end is received.

In a further embodiment, a compression tool is provided for terminating wires to a connector that includes a frame that has a receiving space configured to receive the connector. The frame has at least two frame slots that define different travel paths. A handle is rotatably coupled to the frame. A ram is held by the frame. The ram has an engagement end within the receiving space that is configured to engage the connector. The ram is movable between an initial position and a final position. A link is coupled to the handle. The link has a selector configured to be selectively received in the frame slots and traveling along the corresponding travel path during actuation of the handle. The final position of the ram within the receiving space is controlled based on the frame slot in which the selector is received.

DETAILED DESCRIPTION OF THE INVENTION

Figure 1:
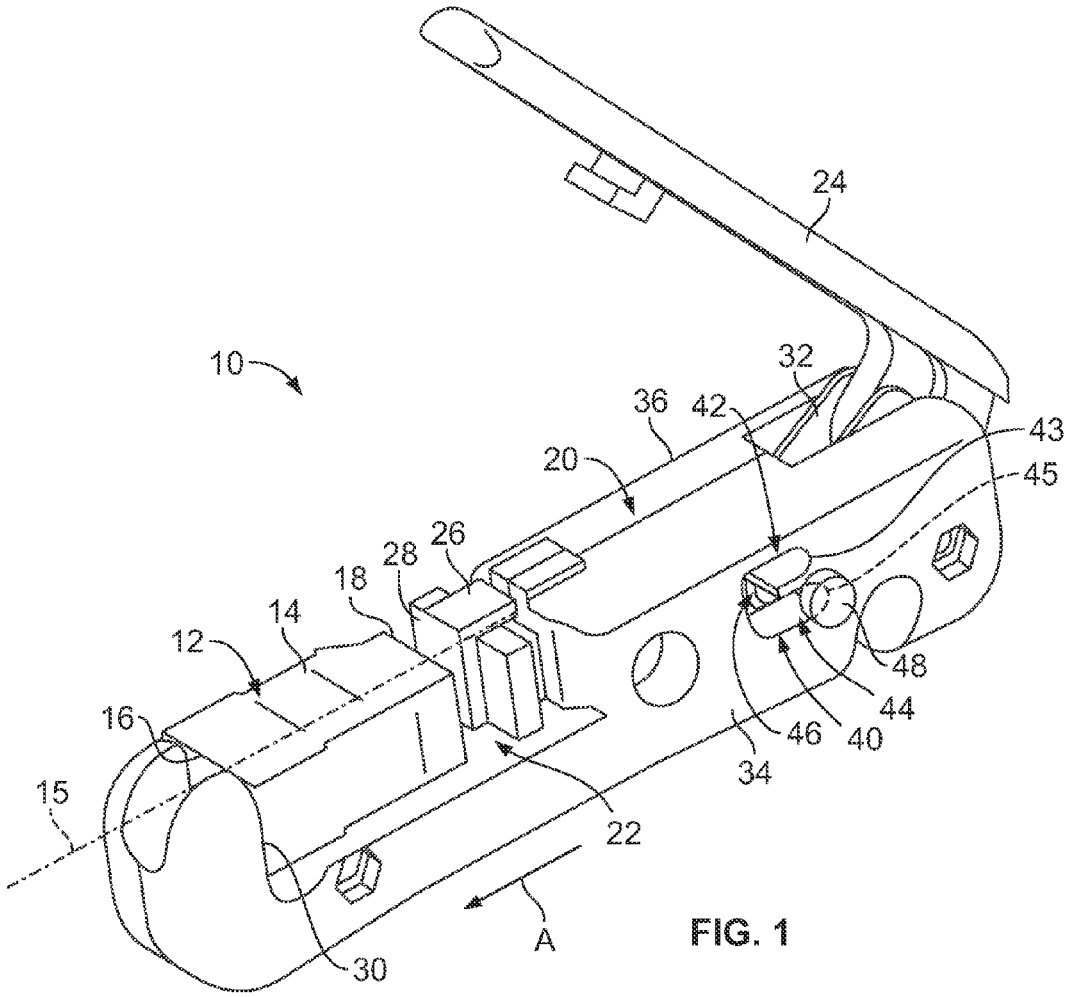
FIG. 1 is a front perspective view of a compression tool formed in accordance with an exemplary embodiment.

FIG. 1 is a front perspective view of a compression tool 10 formed in accordance with an exemplary embodiment. The compression tool 10 is used for terminating wires (not shown) to a connector 12. Optionally, the wires may be laced into a wire organizer integrated into the connector 12 and terminated to the connector 12 when the connector 12 is compressed within the compression tool 10. Alternatively, a separate lacing feature, which is part of the compression tool 10, may be provided and used with the compression tool 10 to terminate the wires to the connector 12.

The compression tool 10 is operated to press the connector 12 onto the wires to terminate the wires to the connector 12. For example, the connector 12 may include insulation displacement contacts (IDCs) that are pressed onto the wires to terminate the wires to the connector 12. Optionally, the wires may be twisted wire pairs that are terminated to the connector 12.

The connector 12 includes a housing 14 along a longitudinal axis 15 extending between a cable end 16 and a mating end 18. A cable, including a plurality of the wires, is fed into the connector 12 through the cable end 16. The cable may be terminated to the connector 12 inside of the housing 14, or alternatively may be terminated to the connector 12 at the cable end 16. The tool provides compression in a direction along the longitudinal axis 15 to terminate the wires to the connector 12.

The compression tool 10 includes a frame 20 having a receiving space 22 that receives the connector 12. The compression tool 10 also includes a handle 24 rotatably coupled to the frame 20 and a ram 26 held by the frame 20 and actuated by the handle 24. The ram 26 has an engagement end 28 positioned within the receiving space 22 that is configured to engage the connector 12. The ram 26 is moveable between an initial position and a final position to compress the wires into the connector 12 the wires to terminate the connector 12. The ram 26 is moveable within the receiving space 22 in a direction parallel to the longitudinal axis 15 to press the connector 12 onto the wires.

In an exemplary embodiment, and as describe in further detail below, the ram 26 is variably positionable with respect to the handle 24 to selectively change a shut height of the compression tool 10. The shut height is defined as a distance between the engagement end 28 of the ram 26 and an end wall 30 of the frame 20 that defines an end of the receiving space 22. The connector 12 is pressed against the end wall 30, and the end wall 30 defines a stop for the connector 12 during compression of the compression tool 10.

During use of the compression tool 10, the handle 24 is rotated or squeezed toward the frame 20 to a closed position. In the closed position, the handle 24 engages the ram 26 to stop the closing action of the handle 24. As the handle 24 is squeezed closed, the handle 24 presses the ram 26 in a compression direction, shown by the arrow A, in which the engagement end 28 of the ram is pressed toward the connector 12 along the longitudinal axis 15. The ram 26 is pressed from the initial position to the final position, and the final position of the ram 26 corresponds with the closed position of the handle 24. In an exemplary embodiment, the ram 26 has more than one final position, such that the engagement end 28 of the ram 26 is positioned different distances from the end wall 30, defining different shut heights.

The compression tool includes a link 32 that extends between the handle 24 and the ram 26. Closing movement of the handle 24 is transferred to the ram 26 by the link 32. In an exemplary embodiment, the link 32 is variably positionable with respect to at least one of the handle 24 or the ram 26 to change the final position of the ram 26 within the receiving space 22 to control the shut height of the compression tool 10. The link 32 is variably positionable with respect to at least one of the handle 24 or the ram 26 to control an effective position of the handle 24 with respect to the ram 26 to define at least two final positions of the ram 26. In the illustrated embodiment, the link 32 is variably positionable with respect to the ram 26 at a separable interface to change the shut height. Alternatively, the link 32 may be variably positionable with respect to the handle 24 to change the shut height.

The frame 20 includes a right shell 34 and a left shell 36 coupled together. The handle 24, ram 26 and link 32 are received in the frame 20 between the right and left shells 34, 36. The frame 20 includes an opening 40 having at least two frame slots 42, 44, representing an upper frame slot 42 and a lower frame slot 44 with a connecting section 46 therebetween. Optionally, the frame 20 includes a J-shaped opening defining the upper frame slot 42 and a J-shaped opening defining the lower frame slot 44. The upper frame slot 42 extends to a back end 43. The lower frame slot 44 extends to a back end 45 (shown in phantom). Optionally, the back end 45 may be positioned further rearward than the back end 43. The frame slots 42, 44 define different travel paths. In an exemplary embodiment, the frame slots 42, 44 define travel paths having different lengths. The link 32 includes a selector 48 that is received in the opening 40. The selector 48 is positionable in one of the frame slots 42 or 44 to change the position of the link 32 with respect to the ram 26. During actuation of the handle 24, the selector 48 travels along the travel path defined by either the upper frame slot 42 or the lower frame slot 44. A travel distance of the selector 48 may be different when traveling along the travel path defined by the upper frame slot 42 as opposed to the travel path defined by the lower frame slot 44. The different lengths of travel correspond to different lengths of travel of the ram 26 within the receiving space 22.

In the illustrated embodiment, the upper frame slot 42 is shorter than the lower frame slot 44. The upper frame slot 42 is positioned forward of the lower frame slot 44. When the selector 48 is in the upper frame slot 42, the link 32, and thus the ram 26, is configured to be moved further forward such that the engagement end 28 is pressed further into the receiving space 22. When the selector 48 travels along the travel path defined by the lower frame slot 44, the link 32, and thus the ram 26, do not travel as far forward and thus the engagement end 28 does not travel as far forward into the receiving space 22. The compression tool 10 is configured to accommodate longer connectors 12 when the selector 48 is in the lower frame slot 44. The compression tool 10 accommodates shorter connectors 12 when the selector 48 is in the upper frame slot 42.

Figure 2:
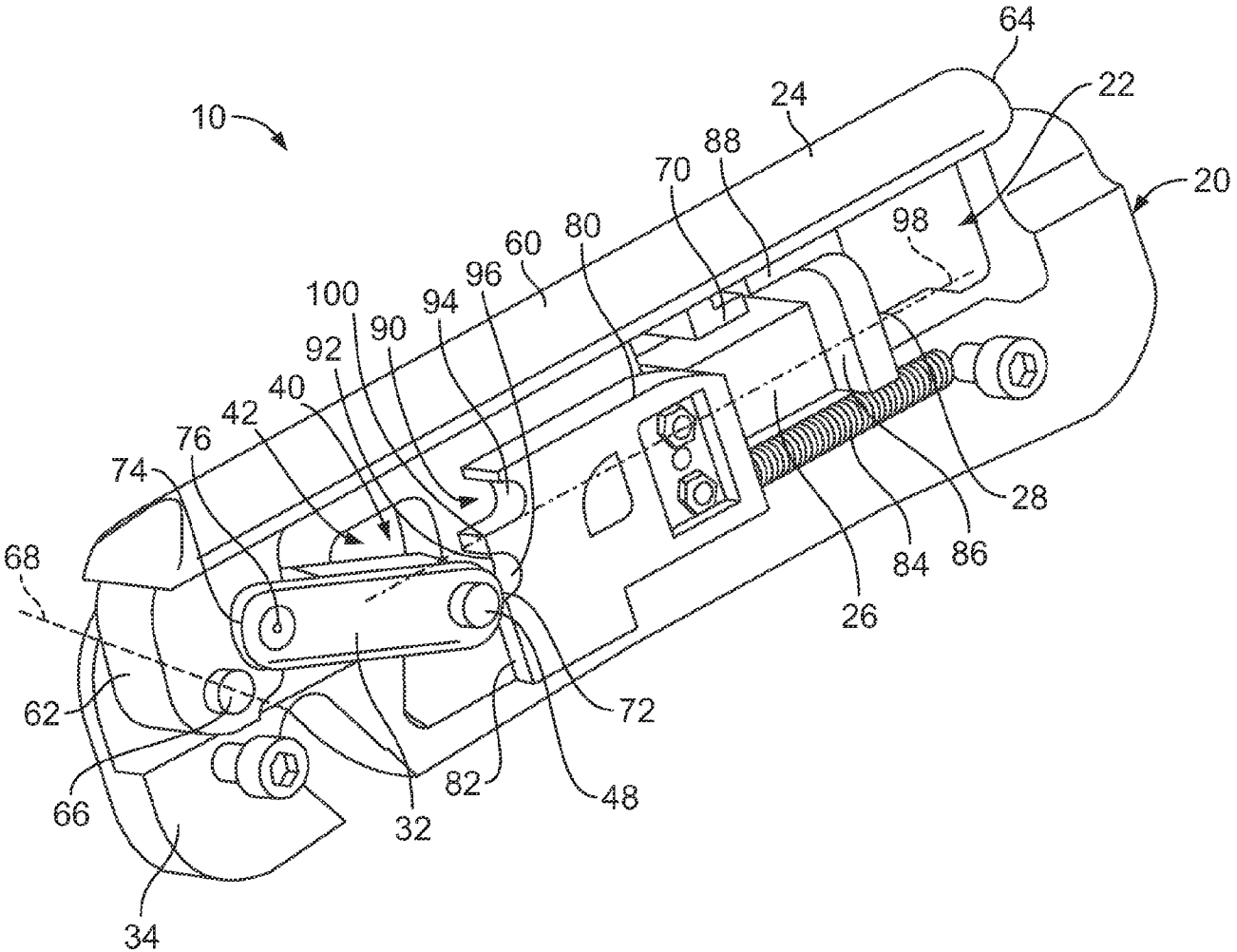
FIG. 2 is a rear perspective view of the compression tool with a portion removed for clarity.

FIG. 2 is a rear perspective view of a portion of the compression tool 10, with the left shell 36 (shown in FIG. 1) removed for clarity. The right shell 34 is illustrated in FIG. 2, along with the handle 24, the ram 26 and the link 32.

The handle 24 includes an arm 60 extending between a fixed 62 and a free end 64. The fixed end 62 includes posts 66 that extend outward and are received in pockets (not shown) of the frame 20. A pivot axis 68 is defined through the posts 66. The handle 24 is rotated about the pivot axis 68. The posts 66 hold the handle 24 within the frame 20. The arm 60 may be pushed or pulled between open and closed positions. In FIG. 2, the arm 60 is shown in a closed position, while the open position is shown in FIG. 1. The arm 60 includes a handle stop 70 extending from a bottom thereof. In the illustrated embodiment, the handle stop 70 is L-shaped. The handle stop 70 defines a latch that is configured to engage the ram 26 to hold the handle 24 in the closed position, such as for storage of the compression tool 10.

The link 32 extends between a ram end 72 and handle end 74. The ram end 72 engages the ram 26. The handle end 74 engages the handle 24. In the illustrated embodiment, the handle end 74 is fixedly coupled to the handle 24. In the illustrated embodiment, the handle end 74 is rotatably coupled to the handle 24 using a pin 76. As the handle 24 is moved between the open and closed position, the link 32 rotates about the pin 76.

The ram end 72 is separably coupled to the ram 26. The ram end 72 may be variably positionable with respect to the ram 26 to control the shut height of the compression tool 10. For example, the ram 26 may be disengaged from the ram end 72 such that the link 32 may be repositioned with respect to the ram 26, and then ram 26 may reengage the ram end 72 at a different portion of the ram 26. The selector 48 is coupled to the link 32 at the ram end 72.

The selector 48 may extend from one or both sides of the link 32 such that the selector 48 may be received in the opening 40 and/or a corresponding opening in the left shell 36 (not shown).

The ram 26 includes a body 80 extending between the engagement end 28 and an actuation end 82. A portion of the body 80 extends into the receiving space 22, while another portion of the body 80 is held internal of the frame 20. In an exemplary embodiment, the ram 26 is spring loaded by a spring 84 that forces the ram 26 in a rearward direction. The force of the spring 84 may be overcome by closing the handle 24 to push the ram 26 forward into the receiving space 22. The spring force 84 may also be overcome by pulling on finger grips 86 at the engagement end 28 to pull the ram 26 forward.

The body 80 includes a ram stop 88 extending from a top of the body 80. The ram stop 88 defines a latch that engages the handle stop 70 to hold the handle 24 in the closed position. When the ram 26 is released, the spring 84 pushes the ram 26 rearward to hold the ram stop 88 in a blocking position over the handle stop 70. Pulling on the finger grips 86 pulls the ram 26 forward such that the handle 24 may be released and the handle stop 70 is able to clear the ram stop 88 to move the handle 24 to the open position.

The ram 26 includes a plurality of ram cradles 90, 92 in the actuation end 82. The ram cradles 90, 92 are configured to receive the ram end 72 of the link 32. The ram end 72 is selectively received in either the ram cradle 90 or the ram cradle 92 to control the shut height. For example, the ram 26 may be actuated to different final positions within the receiving space 22 based on the ram cradle 90 or 92 in which the ram end 72 is received. The ram cradles 90, 92 are open at the actuation end 82. The ram cradles 90, 92 have bottoms 94, 96, respectively, opposite the open ends thereof. The bottoms 94, 96 are offset along a ram axis 98 extending between the engagement end 28 and the actuation end 82. For example, the bottom 94 of the ram cradle 90 is offset forward (e.g., toward the engagement end 28) with respect to the bottom 96. The bottom 96 of the ram cradle 92 is offset rearward (e.g., toward the actuation end 82) with respect to the bottom 94. The ram cradle 90 is positioned above the ram cradle 92.

A separating wall 100 is defined between the ram cradle 90 and the ram cradle 92. In the illustrated embodiment, the ram cradles 90, 92 are curved to receive the selector 48 at the ram end 72 therein. The spring 84 holds the ram 26 against the selector 48 and/or link 32 to hold the selector 48 within the corresponding ram cradle 90 or 92. The ram cradles 90, 92 are sized and shaped to hold the selector 48 therein. The separating wall 100 restricts movement of the selector 48 from one ram cradle 90 or 92 to the other ram cradle 90 or 92. The separating wall 100 avoids accidental adjustment of the link 32 with respect to the ram 26.

In order to move the link 32 from one ram cradle 90 or 92 to the other ram cradle 90 or 92, the ram 26 is pulled forward against the spring bias of the spring 84 to a clearing position in which the ram end 72 may be freely moved up or down within the opening 40 to align the selector 48 with the upper frame slot 42 or the lower frame slot 44 (shown in FIG. 1). Once the link 32 is properly positioned, the ram 26 may be released and the spring 84 pushes the ram 26 rearward until the selector 48 is positioned within the corresponding ram cradle 90 or 92.

Figure 3:
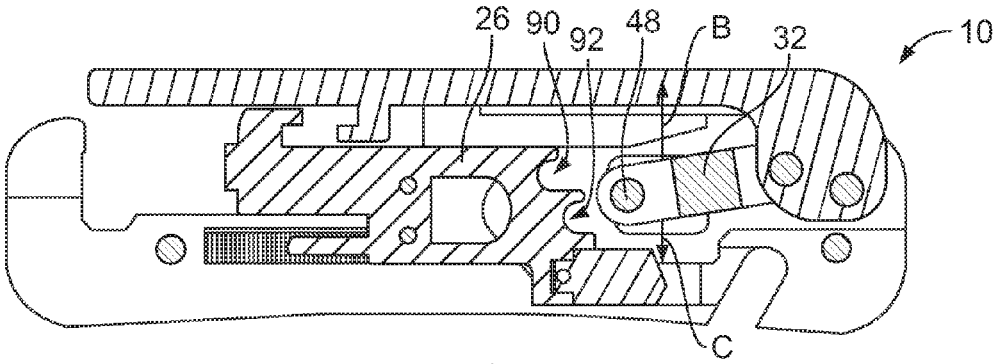
FIG. 3 is a side section view of the compression tool with a portion removed for clarity.

The ram cradles 90, 92 define different driving points on the ram 26 for driving the ram 26. The driving points are located at different depths from the engagement end 28 to change the final position of the ram 26 within the receiving space 22 to control the shut height of the compression tool 10. For example, the upper ram cradle 90 defines a driving point position forward of the lower ram cradle 92. When the selector 48 is positioned in the lower ram cradle 92, the engagement end 28 is driven further forward within the receiving space 22. The compression tool 10 accommodates shorter connectors 12 (shown in FIG. 1) when the link 32 is received in the lower ram cradle 92. When the selector 48 is positioned in the upper ram cradle 90, the ram 26 is driven less into the receiving space 22. The compression tool 10 accommodates longer connectors 12 when the link 32 is received in the upper ram cradle 90. FIG. 3 is a side section view of the compression tool 10 with the left shell 36 (shown in FIG. 1) removed for clarity. FIG. 3 illustrates the ram 26 in the clearance position such that the link 32 is freely moveable to the different positions for engaging different ram cradles 90, 92. For example, the link 32 may be lifted upward, such as in the direction of arrow B, or may be pressed downward, such as in the direction of arrow C, to position the selector 48 in alignment with the upper ram cradle 90 or the lower ram cradle 92. Once the link 32 is positioned, the ram 26 is released and the selector 48 is loaded into the corresponding ram cradle 90 or 92.

Figure 4:
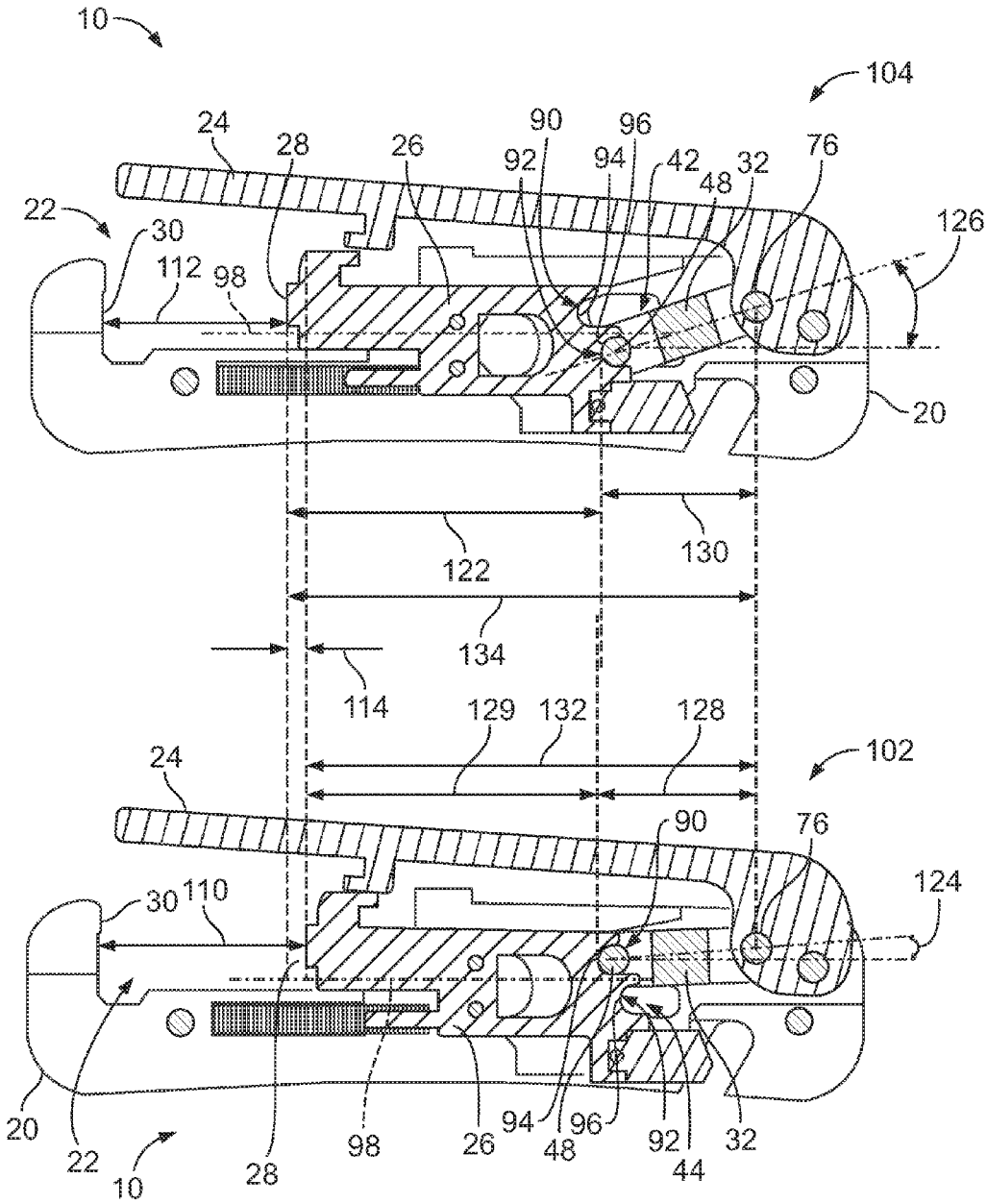
FIG. 4 illustrates two section views of the compression tool, showing the compression tool in a large shut height position and in a small shut height position.

FIG. 4 illustrates two section views of the compression tool 10, showing the compression tool 10 in a large shut height position 102 and in a small shut height position 104. The left shell 36 (shown in FIG. 1) has been removed for clarity.

The compression tool 10 is variably positionable between the large and small shut height positions 102, 104 by toggling the selector 48 between an up position (corresponding with the large shut height position 102) and a down position (corresponding with the small shut height position 104). In the large shut height position 102, the selector 48 is positioned in the upper ram cradle 90. In the small shut height position 104, the selector 48 is positioned in the lower ram cradle 92. In the large shut height position 102, the compression tool 10 has a first shut height 110 defined between the end wall 30 and the engagement end 28 of the ram 26. In the small shut height position 104, the compression tool 10 has a second shut height 112 defined between the end wall 30 and the engagement end 28 of the ram 26. The second shut height 112 is smaller than the first shut height 112, with the engagement end 28 of the ram 26 being positioned closer to the end wall 30 to accommodate smaller connectors 12 (shown in FIG. 1). A difference 114 between the first and second shut heights 110, 112 is shown in FIG. 4. The amount of difference 114 may be different in alternative embodiments. Additionally, more than two different positions may be achieved by the compression tool 10 in alternative embodiments by providing more ram cradles, such as to accommodate more than two different sized connectors 12.

The compression tool 10 has an effective arm length defined between the engagement end 28 and the pivot point between the link 32 and the handle 24, defined at the pin 76. The effective arm length determines the shut height. The effective arm length is a function of an effective ram length and an effective link length. The effective lengths are measured linearly along the longitudinal axis of the compression tool 10.

The effective ram length is defined between the engagement end 28 and the bottom 94 or 96 of the ram cradle 90, 92 that holds the link 32. Because the bottoms 94, 96 are positioned at different axial positions along the ram axis 98, the effective ram length is variable based on which ram cradle 90 or 92 in which the link 32 is received. The bottom 94 of the upper ram cradle 90 is positioned forward of the bottom 96 of the lower ram cradle 92 making the effective ram length shorter when the link 32 is received in the upper ram cradle 90 and longer when the link 32 is received in the lower ram cradle 92. In the illustrated embodiment, in the large shut height position 102, the effective ram length is represented by a length 120. In the small shut height position 104, the effective ram length is represented by a length 122. The length 122 is longer than the length 120.

The effective link length is defined between the engagement point between the selector 48 and the bottom 94 or 96 and the pivot point at the pin 76. The effective link length is also controlled based on an angle 124 or 126 of the link 32. Because the link 32 is rotatable, the angles 124, 126 are different, which affects the effective link length. In the illustrated embodiment, in the large shut height position 102, the effective link length is represented by a length 128. In the small shut height position 104, the effective link length is represented by a length 130. When the link 32 is received in the upper ram cradle 90, the effective link length 128 is longer. When the link 32 is received in the lower ram cradle 90, the effective link length 130 is shorter because the angle 126 is greater than the angle 124.

The effective arm length is the sum of the effective ram length and the effective link length. In the illustrated embodiment, in the large shut height position 102, the effective arm length is represented by a length 132. In the small shut height position 104, the effective arm length is represented by a length 134 which is longer than the length 132. Because the effective arm length 134 is longer than the effective arm length 132, the shut height 112 is smaller than the shut height 114. In the small shut height position 104, the ram 26 is pushed further forward into the receiving space 22 closer to the end wall 30.

The compression tool 10 includes an assembly that allows the shut height to be selectable to accommodate different size connectors 12. The selector 48 is variably positionable with respect to the ram 26 to change the effective arm length of the ram 26/link 32. The ram 26 has different ram cradles 90, 92 to receive the selector 48 to vary the position of the link 32 with respect to the ram 26. The frame 20 has different frame slots 42, 44 that accommodate the selector 48 in the different positions. In an alternative embodiment, the link 32 may be variably positionable with respect to the handle 24 in addition to, or in the alternative to, the ram 26 to define multiple shut heights for the compression tool 10.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A compression tool for terminating wires to a connector, the compression tool comprising:

a frame having a receiving space configured to receive the connector, the frame having at least two frame slots that define different travel paths, the travel paths having different lengths;

a handle rotatably coupled to the frame;

a ram held by the frame, the ram having an engagement end within the receiving space that is configured to engage the connector, the ram movable between an initial position and a final position; and a link coupled between the ram and the handle and the link being in contact with the ram and with the handle, the link being variably positionable with respect to at least one of the handle or the ram to change the final position of the ram within the receiving space to control a shut height of the compression tool, the link having a selector configured to be selectively received in the frame slots and traveling along the corresponding travel path during actuation of the handle, wherein the final position of the ram within the receiving space is controlled based on in which frame slot the selector is received.

2. The compression tool of claim 1, wherein the link is variably positionable with respect to at least one of the handle or the ram to control an effective position of the handle with respect to the ram to define at least two final positions of the ram.

3. The compression tool of claim 1, wherein the ram has at least two final mating positions corresponding to different shut heights, the final positions being controlled based on the position of the link with respect to the ram.

4. The compression tool of claim 1, wherein the ram has an actuation end opposite the engagement end, the ram having at least two ram cradles in the actuation end, the link being selectively received in a corresponding ram cradle to control the final position of the ram within the receiving space.

5. The compression tool of claim 1, wherein the at least two frame slots are open along an exterior side of the frame, the selector being exposed along an exterior of the frame to be actuated by a user to one of the at least two frame slots.

6. The compression tool of claim 1, wherein the ram has an actuation end opposite the engagement end, the ram having at least two ram cradles in the actuation end, the link being selectively received in the ram cradles, the ram cradles having bottoms at different distances from the engagement end to control the final position of the ram within the receiving space based on the ram cradle in which the link is received.

7. The compression tool of claim 1, wherein the frame includes an end wall at an end of the receiving space, the shut height being defined between the engagement end and the end wall when the ram is in the final position.

8. The compression tool of claim 1, wherein the link is pivotably coupled to the handle at a pivot point, the compression tool having an effective arm length defined between the pivot point and the engagement end, the effective arm length being variable by varying the position of the link with respect to the ram.

9. The compression tool of claim 1, wherein the ram extends along a ram axis between the engagement end and an actuation end, the ram having ram cradles at the actuation end, the ram cradles being open at the actuation end, the ram cradles having bottoms opposite the open actuation ends thereof, the bottoms being offset in a direction along the ram axis.

10. The compression tool of claim 1, wherein the at least two frame slots are defined by a J-shaped opening defining an upper frame slot and a J-shaped opening defining a lower frame slot with a connecting section therebetween, the upper frame slot having a back end, the lower frame slot having a back end rearward of the back end of the upper frame slot.

11. The compression tool of claim 1, wherein the ram is movable with respect to the frame, the ram changing relative position with respect to the frame slots as the ram is moved from the initial position to the final position.

12. A compression tool for terminating wires to a connector, the compression tool comprising:

a frame having a receiving space configured to receive the connector, wherein the frame has at least two frame slots that define different travel paths, the travel paths having different lengths;

a handle rotatably coupled to the frame;

a ram held by the frame, the ram having an engagement end within the receiving space that is configured to engage the connector, the ram having an actuation end opposite the engagement end, the ram having at least two ram cradles in the actuation end, the ram movable between an initial position and a final position; and a link coupled to the handle, the link having a ram end configured to be selectively received in the ram cradles, wherein the final position of the ram within the receiving space is controlled based on the rain cradle in which the ram end is received, the link having a selector configured to be selectively received in the frame slots and traveling along the corresponding travel path during actuation of the handle, wherein the final position of the ram within the receiving space is controlled based on which frame slot the selector is received.

13. The compression tool of claim 12, wherein the link is variably positionable with respect to the ram to control an effective position of the handle with respect to the ram to define at least two final positions of the ram.

14. The compression tool of claim 12, wherein the ram has at least two final mating positions corresponding to different shut heights, the final positions being controlled based on the position of the link with respect to the handle and the ram.

15. The compression tool of claim 12, wherein the ram cradles have bottoms at different depths from the engagement end to control the final position of the ram within the receiving space based on the ram cradle in which the link is received.

16. The compression tool of claim 12, wherein the link is pivotably coupled to the handle at a pivot point, the compression tool having an effective arm length defined between the pivot point and the engagement end, the effective arm length being variable by moving the ram end of the link into a different ram cradle.

17. The compression tool of claim 12, wherein the ram extends along a ram axis between the engagement end and the actuation end, the ram cradles being open at the actuation end, the ram cradles having bottoms opposite the open ends thereof, the bottoms being offset along the ram axis.

18. A compression tool for terminating wires to a connector, the compression tool comprising:

a frame having a receiving space configured to receive the connector, the frame having at least two frame slots that define different travel paths;

a handle rotatably coupled to the frame;

a ram held by the frame and movable relative to the frame, the ram having an engagement end within the receiving space that is configured to engage the connector, the ram movable between an initial position and a final position, the ram changing relative position with respect to the frame slots as the ram is moved from the initial position to the final position; and a link coupled to the handle, the link having a selector configured to be selectively received in the frame slots and traveling along the corresponding travel path during actuation of the handle, wherein the final position of the ram within the receiving space is controlled based on the frame slot in which the selector is received.

19. The compression tool of claim 18, wherein the link is variably positionable with respect to the ram to control an effective position of the handle with respect to the ram to define at least two final positions of the ram.

20. The compression tool of claim 18, wherein the ram has at least two final mating positions corresponding to different shut heights, the final positions being controlled based on the position of the link with respect to the handle and the ram.

* * * * *